US005257746A

United States Patent [19]

Norrvi et al.

[11] Patent Number: 5,257,746

[45] Date of Patent: Nov. 2, 1993

[54] DEVICE FOR WINDING AND UNWINDING A WIRE

[75] Inventors: Hans Norrvi, Vreta Kloster; Ingemar Krantz, Linköping, both of Sweden

[73] Assignee: Saab Missiles Aktiebolag, Sweden

[21] Appl. No.: 773,871

[22] PCT Filed: Dec. 11, 1990

[86] PCT No.: PCT/SE90/00821

§ 371 Date: Oct. 25, 1991

§ 102(e) Date: Oct. 25, 1991

[87] PCT Pub. No.: WO91/11384

PCT Pub. Date: Aug. 8, 1991

[30] Foreign Application Priority Data

Jan. 23, 1990 [SE] Sweden ..... 9000230

[51] Int. Cl.[5] ..... B65H 75/00

[52] U.S. Cl. ..... 242/54 R; 242/158.2

[58] Field of Search ..... 242/54 R, 7.22, 157 R, 242/158.2

[56] References Cited

U.S. PATENT DOCUMENTS 2,858,085 10/1958 Strang ..... 242/54 R
3,003,748 11/1959 Musser ..... 242/54 R
3,670,977 6/1972 Boneck ..... 242/54 R
3,851,831 12/1974 Steiner et al. ..... 242/7.22
3,908,922 9/1975 Guthrie et al. ..... 242/54 R
4,830,298 5/1989 Van Blunk ..... 242/157 R
4,842,108 6/1989 Anderson et al. ..... 242/54 R X

FOREIGN PATENT DOCUMENTS 1382880 2/1975 United Kingdom .
2143870 2/1985 United Kingdom .
2219787 12/1989 United Kingdom .

*Primary Examiner*—Daniel P. Stodola
*Assistant Examiner*—John F. Rollins
*Attorney, Agent, or Firm*—Lowe, Price, LeBlanc & Becker

[57] ABSTRACT

A device for winding and unwinding a multi-layer coil comprising a winding element in the form of a drum with a wire guidance assembly rotatably mounted relative to the drum and capable of axial movement with respect thereto. The wire guidance assembly includes a series of conical rollers mounted for rotation on axes substantially perpendicular to the axis of the drum. The wire guidance assembly is rotated relative to the drum and the surfaces of the conical rollers cause winding of the wire in multi-turn layers commencing at the drum and expanding in circumference outward to a maximum diameter.

1 Claim, 3 Drawing Sheets

DEVICE FOR WINDING AND UNWINDING A WIRE

The present invention relates to a device for winding and unwinding a wire, such as a relatively thin electric insulated cable, comprising a winding element and a wire guidance means rotatable about the winding element and axially movable along the winding element.

Such devices are known and comprise a rotation-symmetrical cylindrical wire drum which constitutes the winding element. This wire drum is rotatably mounted in a stand and is driven by a motor. A guide rail is attached to the stand and extends parallel to the wire o o drum. A wire guidance means in the form of a wire guide is movable on the guide rail. A wire is wound on and off the wire drum in a manner such that the wire drum rotates at a constant speed while the wire guide guides the wire during a forward and backward movement on the guide rail.

It will be realized that a device of this kind has a relatively high space requirement. This becomes obvious in situations where the diameter is limited and it is desired that the device shall permit unwinding and winding of as long a wire as possible.

The object of the present invention is to accomplish a device of the type described that permits a maximum portion of the radial space occupied by the device to hold wound wire. The device also provides simple construction and reliable functioning.

According to the invention such a device is primarily characterized in that the circumference of the winding element and its speed of rotation and the first speed of axial movement are varied with respect to one another and with respect to the diameter of the wire so that wire is wound up on the winding element by means of the wire guidance means in layer by layer fashion respectively from the surface of the winding element up to a maximum radial extension.

The relative rotatability and axial movement, respectively, between the winding element and the wire guidance means is usually achieved with the aid of one or several electric motors via gearing and steering devices of kinds which are, per se, known.

In a suitable embodiment the wire guidance means comprises a series of supporting rolls having supporting surfaces rotatable about axes which form an angle with the longitudinal axis of the winding element. Suitably the supporting surfaces are so designed that the generatrices for said supporting surfaces in a plane through the longitudinal axis of the winding element, as seen from the end of the winding element where the winding of the wire is begun, form an angle smaller than 90°. The supporting rolls can be shaped as a frustum of a cone to form a supporting surface having the smaller portion directed inward toward the winding element.

The device according to the invention will now be described in detail with reference to the accompanying figures of which:

Figure 1:
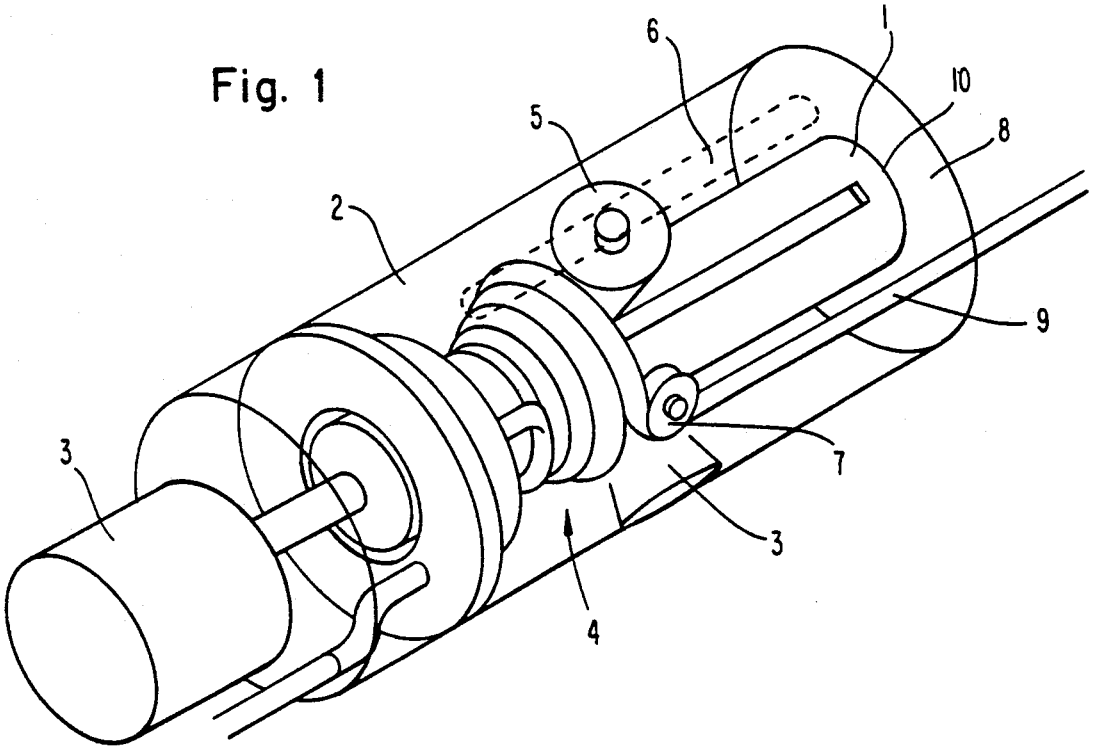
FIG. 1 shows schematically in perspective a first embodiment of the device according to the invention.

In FIG. 1 a winding element is designated by 1. The winding element 1 consists of a cylindrical drum which is mounted in a housing 2 and rotatable relative to the housing by means of a motor 3 via a gear reduction set which is not shown. A wire guidance means 4 is rotatable about the winding element 1 and axially displaceable along the winding element. The wire guidance means comprises three conical supporting rolls 5 having their smaller ends directed inward toward the winding element. The supporting rolls are rotatable about axes extending at right angles from a sleeve assembly which embraces and is rotatable on the winding element. Relative to the housing the wire guidance means 4 is axially displaceable guided by guidance means 6 which is shown in phantom in FIG. 1. The wire guidance means 4 is provided with a pulley 7 over which the wire 9 entering through an opening in one end wall 8 of the device bends and is wound up on the winding element 1.

Figure 2:
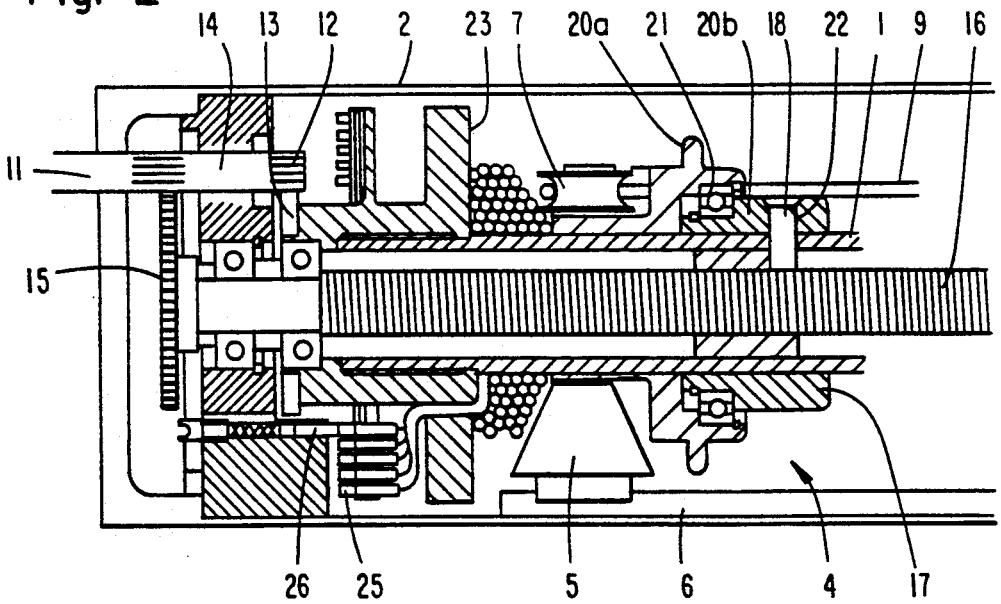
FIG. 2 shows a longitudinal section through the device in FIG. 1 in part.

In FIG. 2 the construction and function of this embodiment of the invention is shown in more detail. In that Figure details corresponding to those in FIG. 1 are designated by the same reference numbers. The winding element or drum 1 is shown mounted at one end in a bearing 10. There are similar bearings in the other end of the device, not shown, and one side wall of the device is likewise not shown. The axis of the motor is designated by 11. It is at one end provided with a first gear wheel 12 which drives a gear ring 13 on the winding element and thereby drives the winding element. On the axis 11 there is a second gear wheel 14 which drives a third gear wheel 15 and thereby drives a feed control screw 16 coaxial with the winding element placed inside of the winding element. On the feed control runs a nut 17 provided with a pin 18 which extends up through an axial groove 19 (see FIG. 1) in the winding element 1. When the feed control rotates the nut 17 is fed axially in either direction in the device depending on the direction of rotation.

As mentioned above, the wire guidance means 4 comprises a sleeve assembly. This includes a first sleeve **20*a* which carries the three supporting rolls 5, the pulley 7, and a second sleeve 20*b*. The sleeves are rotational with respect to one another by means of a bearing 21 but are axially locked together. The pin 18 engages in a recess 22 in the sleeve 20*b*. Through this construction the wire guidance means 4 can be fed axially relative to the winding element 1** while the latter is rotating.

The winding element 1 is provided with a limiting wall 23 at its inner end formed as a flange. The wire 9 is guided through this limiting wall onto contact means 24 in the form a concentric contact rings 25 intended to conduct electric current to the contact pin of which only one is shown at 26. This contact means is essential in this embodiment as the winding element rotates relative to the housing 2 which is rigidly connected to the motor stand which is not shown in the figure.

According to the invention the circumference of the winding element, the speed of rotation and axial speed of the wire guidance means about and along the winding element are now varied in relation to the diameter of the wire so that the wire is winding on the winding element by means of the wire guidance means in a layer by layer fashion from the surface of the winding element to a maximum radial extension.

Figure 3:
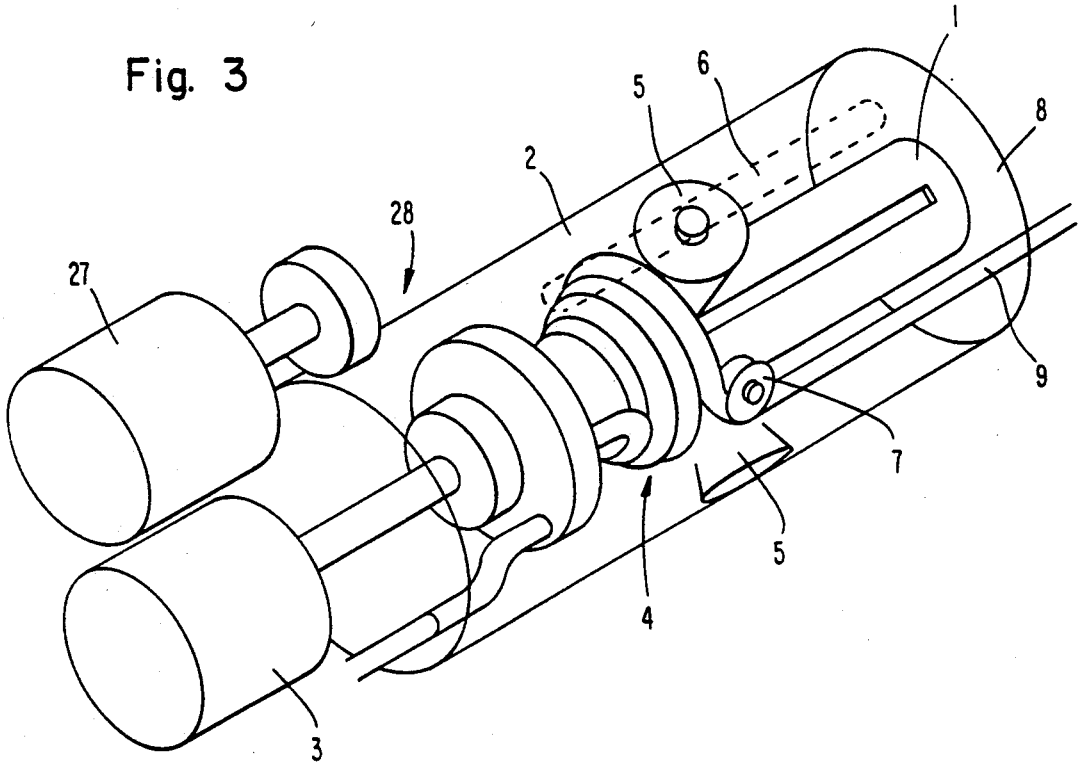
FIG. 3 shows schematically in perspective a second embodiment of the device according to the invention.

Another embodiment of the device according to the invention is presented in FIG. 3. The reference numbers in this figure refer to corresponding details in FIG. 1 with the exception of one additional motor designated by 27 in FIG. 3. In this embodiment the winding element 1 is stationary in relation to the motors 3 and 27 and parts related thereto. The housing 2 is instead rotatable about the winding element 1 by means of the motor 27 via a gear reduction 28. The wire guidance means is made to rotate about the winding element 1 in that it is forced to follow the rotation of the housing. The axial feeding by the wire guidance means 4 takes place in the same manner as in the embodiment according to FIGS. 1 and 2.

Figure 4:
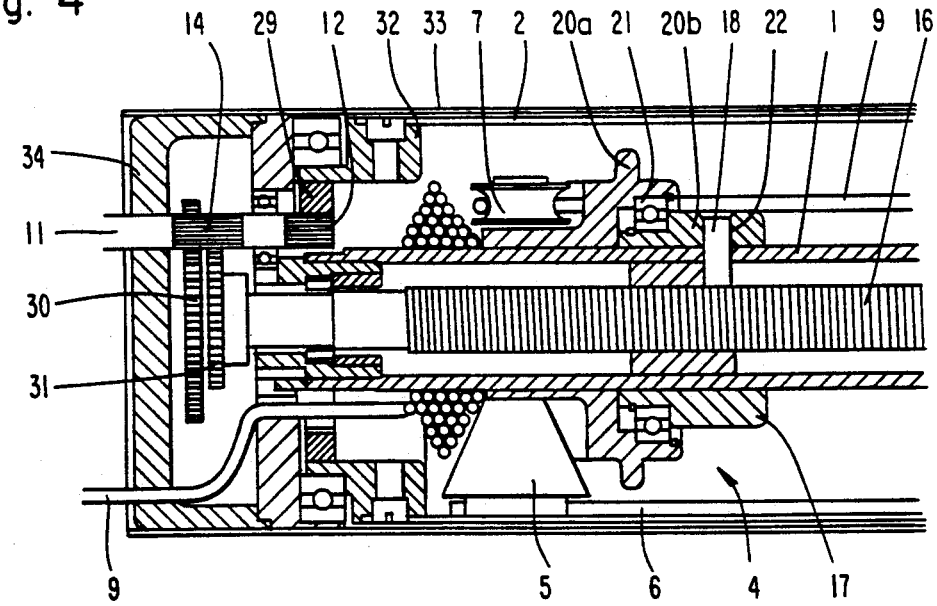
FIG. 4 shows a longitudinal section through the device in FIG. 3 in part.

In FIG. 4 the construction and function is shown more in detail. Most details are repeated with the same designations as seen in FIG. 2. The first gear wheel 12, however, drives the housing 2 via a second gear ring 29 while the feed control 16 is driven by the second gear wheel 14 via a fourth gear wheel 30, not shown, smaller fifth gear wheel on the same axis as the gear wheel 30, and a sixth gear wheel 31. A second limiting wall 32 in the form of a flange extends inward from the housing 2. No contact means is required here because the winding element 1 is fixed relative to a stand comprising an external housing 33 and a side wall 34 in which the stand of the motor, not shown, is attached.

The function of this embodiment in other respects is the same as in the above mentioned embodiment.

Figure 5:
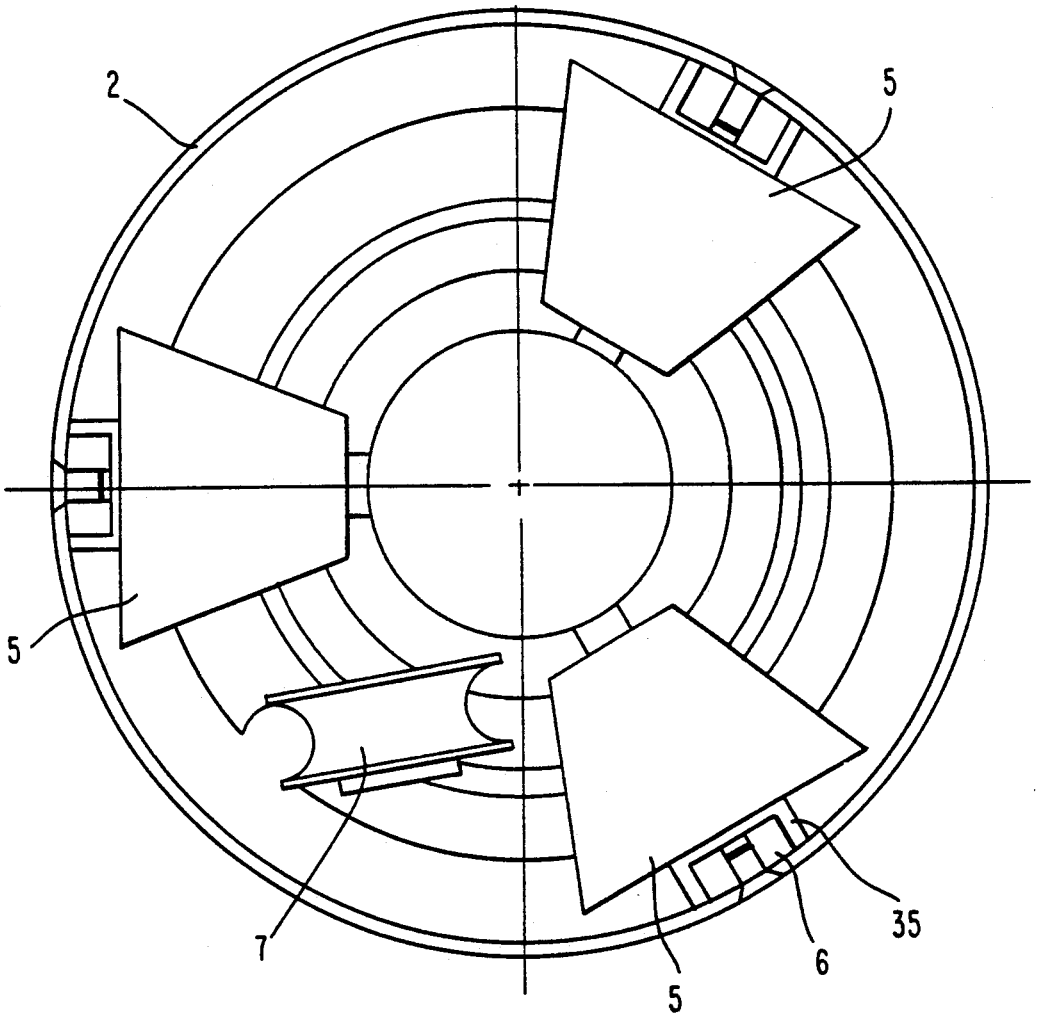
FIG. 5 shows a view of a wire guidance means.

In FIG. 5 for the sake of clarity there is shown a view of a wire guidance means of the type comprised in the devices of the above mentioned figures. The three supporting rolls 5 are symmetrically provided around the circumference of the wire guidance means 4. Each supporting roll 5 is provided with a guiding element 35 guided by the guidance means 6.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A device for winding and unwinding an electric insulated cable comprising a winding element having a longitudinal axis and a wire guidance means rotatable about the winding element characterized in that the wire guidance means is rotated with respect to the winding element and is moved axially with respect thereto to wind a multilayer coil of said wire and in so doing to define an increasing winding circumference so that the wire is wound upon itself turn by turn from the surface of the winding element to a maximum radius and circumference at the outermost layer of the coil, said wire guidance means comprising a series of supporting rolls having conical surfaces rotating about axes at an angle to the longitudinal axis of said winding element, said conical supporting surfaces having their apexes directed toward said longitudinal axis so that their outmost surfaces define a frusto conical surface having an angle of less than 90° with respect to the said longitudinal axis.

* * * * *